US010590710B2

(12) United States Patent
Vempati et al.

(10) Patent No.: US 10,590,710 B2
(45) Date of Patent: Mar. 17, 2020

(54) CUTTING ELEMENTS, EARTH-BORING TOOLS INCLUDING THE CUTTING ELEMENTS, AND METHODS OF FORMING THE CUTTING ELEMENTS

(71) Applicant: Baker Hughes, a GE company, LLC, Houston, TX (US)

(72) Inventors: Chaitanya K. Vempati, Conroe, TX (US); Juan Miguel Bilen, The Woodlands, TX (US); Anthony Phillips, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 174 days.

(21) Appl. No.: 15/374,891

(22) Filed: Dec. 9, 2016

(65) Prior Publication Data

US 2018/0163482 A1 Jun. 14, 2018

(51) Int. Cl.

| | |
|---|---|
| ***E21B 10/42*** | (2006.01) |
| ***E21B 10/58*** | (2006.01) |
| ***B24D 18/00*** | (2006.01) |

(52) U.S. Cl.

CPC ..... *E21B 10/42* (2013.01); *E21B 10/58* (2013.01); *B24D 18/0009* (2013.01)

(58) Field of Classification Search

CPC ..... E21B 10/52; E21B 10/55; E21B 10/62; E21B 10/42; E21B 10/58; E21B 10/5673; E21B 2010/562; B24D 18/0009

See application file for complete search history.

(56) References Cited

U.S. PATENT DOCUMENTS

| | | | |
|---|---|---|---|
| 4,334,586 | A | 6/1982 | Schumacher |
| 5,172,777 | A | 12/1992 | Siracki et al. |
| 5,287,936 | A | 2/1994 | Grimes et al. |

(Continued)

FOREIGN PATENT DOCUMENTS

WO 2016/176221 A1 11/2016

OTHER PUBLICATIONS

International Written Opinion for International Application No. PCT/IB2017/001692 dated Oct. 29, 2018, 7 pages.

(Continued)

*Primary Examiner* — George S Gray
(74) *Attorney, Agent, or Firm* — TraskBritt

(57) ABSTRACT

A cutting element comprises a supporting substrate, and a cutting table attached to the supporting substrate and comprising a substantially planar apex, opposing flat surfaces extending upwardly and inwardly toward the substantially planar apex from locations proximate an interface between the cutting table and the supporting substrate, primary edge surfaces between the substantially planar apex and the opposing flat surfaces and exhibiting one or more of a radiused geometry and a chamfered geometry, opposing semi-conical surfaces intervening between the opposing flat surfaces and extending upwardly and inwardly toward the substantially planar apex from other locations proximate the interface between the cutting table and the supporting substrate, and secondary edge surfaces between the substantially planar apex and the opposing semi-conical surfaces and exhibiting one or more of another radiused geometry and another chamfered geometry.

18 Claims, 6 Drawing Sheets

(56) References Cited

U.S. PATENT DOCUMENTS 5,322,138 A 6/1994 Siracki
5,346,026 A 9/1994 Pessier et al.
5,421,423 A 6/1995 Huffstutler
5,467,836 A 11/1995 Grimes et al.
5,655,612 A 8/1997 Grimes et al.
5,752,573 A 5/1998 Scott et al.
5,890,552 A 4/1999 Scott et al.
6,050,354 A 4/2000 Pessier et al.
6,176,333 B1 1/2001 Doster
6,241,035 B1 * 6/2001 Portwood ..... B23P 15/28 175/374
6,332,503 B1 12/2001 Pessier et al.
6,499,547 B2 12/2002 Scott et al.
7,223,049 B2 5/2007 Hall et al.
7,347,292 B1 3/2008 Hall et al.
7,338,135 B1 5/2008 Hall et al.
7,384,105 B2 6/2008 Hall et al.
7,387,345 B2 6/2008 Hall et al.
7,387,464 B2 6/2008 Hall et al.
7,387,465 B2 6/2008 Hall et al.
7,390,066 B2 6/2008 Hall et al.
7,396,085 B2 7/2008 Hall et al.
7,396,086 B1 7/2008 Hall et al.
7,401,863 B1 7/2008 Hall et al.
7,410,221 B2 8/2008 Hall et al.
7,413,256 B2 8/2008 Hall et al.
7,413,258 B2 8/2008 Hall et al.
7,413,375 B2 8/2008 Hall
7,419,224 B2 9/2008 Hall et al.
7,445,294 B2 11/2008 Hall et al.
7,464,993 B2 12/2008 Hall et al.
7,469,756 B2 12/2008 Hall et al.
7,469,971 B2 12/2008 Hall et al.
7,473,052 B2 1/2009 Hall et al.
7,475,948 B2 1/2009 Hall et al.
7,544,011 B2 6/2009 Hall et al.
7,549,821 B2 6/2009 Hall et al.
7,568,770 B2 8/2009 Hall et al.
7,588,102 B2 9/2009 Hall et al.
7,591,607 B2 9/2009 Hall et al.
7,600,823 B2 10/2009 Hall et al.
7,635,168 B2 12/2009 Hall et al.
7,637,574 B2 12/2009 Hall et al.
7,641,418 B2 1/2010 Hall et al.
7,648,210 B2 1/2010 Hall et al.
7,661,765 B2 2/2010 Hall et al.
7,665,552 B2 2/2010 Hall et al.
7,669,674 B2 3/2010 Hall et al.
7,669,938 B2 3/2010 Hall et al.
7,676,968 B2 3/2010 Hall et al.
7,681,338 B2 3/2010 Hall et al.
7,686,536 B2 3/2010 Hall et al.
7,690,138 B2 4/2010 Hall et al.
7,712,693 B2 5/2010 Hall
7,717,365 B2 5/2010 Hall
7,722,127 B2 5/2010 Hall
7,740,414 B2 6/2010 Hall et al.
7,744,164 B2 6/2010 Hall et al.
7,832,809 B2 11/2010 Hall et al.
7,854,078 B2 12/2010 Hall et al.
7,862,126 B2 1/2011 Hall et al.
7,871,133 B2 1/2011 Hall et al.
7,886,851 B2 2/2011 Hall et al.
7,946,656 B2 5/2011 Hall et al.
7,946,657 B2 5/2011 Hall et al.
7,950,170 B2 5/2011 Hall et al.
7,950,746 B2 5/2011 Hall et al.
7,963,617 B2 6/2011 Hall et al.
7,992,944 B2 8/2011 Hall et al.
7,992,945 B2 8/2011 Hall et al.
7,997,661 B2 8/2011 Hall et al.
8,007,050 B2 8/2011 Hall et al.
8,007,051 B2 8/2011 Hall et al.
8,028,774 B2 10/2011 Hall et al.
8,029,068 B2 10/2011 Hall et al.
8,033,615 B2 10/2011 Hall et al.
8,033,616 B2 10/2011 Hall et al.
8,038,223 B2 10/2011 Hall et al.
8,061,784 B2 11/2011 Hall et al.
8,109,349 B2 2/2012 Hall et al.
8,116,953 B2 2/2012 Lopez
8,118,371 B2 2/2012 Hall et al.
8,122,980 B2 2/2012 Hall et al.
8,123,302 B2 2/2012 Hall et al.
8,136,887 B2 3/2012 Hall
8,191,651 B2 6/2012 Hall et al.
8,201,892 B2 6/2012 Hall et al.
8,215,420 B2 7/2012 Hall et al.
8,240,404 B2 8/2012 Hall et al.
8,292,372 B2 10/2012 Hall et al.
8,365,845 B2 2/2013 Hall et al.
8,414,085 B2 4/2013 Hall et al.
8,414,805 B2 4/2013 Wang
8,434,573 B2 5/2013 Hall et al.
8,449,040 B2 5/2013 Hall et al.
8,453,497 B2 6/2013 Hall et al.
8,454,096 B2 6/2013 Hall et al.
8,485,609 B2 7/2013 Hall et al.
8,500,209 B2 8/2013 Hall et al.
8,500,210 B2 8/2013 Hall et al.
8,505,634 B2 8/2013 Lyons et al.
8,534,767 B2 9/2013 Hall et al.
8,550,190 B2 10/2013 Hall et al.
8,567,532 B2 10/2013 Hall et al.
8,616,305 B2 10/2013 Hall et al.
8,573,331 B2 11/2013 Hall et al.
8,590,644 B2 11/2013 Hall et al.
8,596,381 B2 12/2013 Hall et al.
8,622,155 B2 1/2014 Hall et al.
8,646,848 B2 2/2014 Hall et al.
8,714,285 B2 5/2014 Hall et al.
8,794,356 B2 8/2014 Lyons et al.
8,839,888 B2 9/2014 Hall et al.
8,851,207 B2 10/2014 Gavia et al.
8,960,337 B2 2/2015 Hall et al.
8,998,346 B2 4/2015 Hall et al.
9,051,795 B2 6/2015 Hall et al.
9,068,410 B2 6/2015 Hall et al.
9,074,435 B2 7/2015 Scott et al.
9,145,742 B2 9/2015 Hall et al.
9,200,483 B2 12/2015 Gavia et al.
9,316,061 B2 4/2016 Hall et al.
9,366,089 B2 6/2016 Hall et al.
2008/0035389 A1 2/2008 Hall et al.
2008/0036278 A1 2/2008 Hall et al.
2008/0053710 A1 * 3/2008 Moss ..... E21B 10/52 175/426
2008/0099249 A1 5/2008 Hall et al.
2008/0172627 A1 7/2008 Hagawa et al.
2008/0187452 A1 8/2008 Hall et al.
2010/0059289 A1 3/2010 Hall et al.
2010/0065339 A1 3/2010 Hall et al.
2010/0071964 A1 3/2010 Hall et al.
2010/0237135 A1 9/2010 Hall et al.
2010/0244545 A1 9/2010 Hall et al.
2011/0240369 A1 10/2011 Hall et al.
2011/0240377 A1 10/2011 Hall et al.
2011/0240378 A1 10/2011 Hall et al.
2011/0247882 A1 10/2011 Hall et al.
2011/0254349 A1 10/2011 Hall et al.
2011/0254350 A1 10/2011 Hall et al.
2012/0025592 A1 2/2012 Hall et al.
2012/0261977 A1 10/2012 Hall et al.
2013/0172868 A1 7/2013 Bonfeld
2013/0172869 A1 7/2013 Bonfeld
2013/0199856 A1 * 8/2013 Bilen ..... E21B 10/5673 175/331
2013/0341999 A1 12/2013 Hall et al.
2014/0084669 A1 * 3/2014 Jonker ..... E21C 35/183 299/79.1
2014/0284117 A1 9/2014 Suresh
2015/0027786 A1 1/2015 Hall et al.
2015/0122553 A1 5/2015 Hall et al.
2015/0129322 A1 5/2015 Hall et al.

(56) References Cited

U.S. PATENT DOCUMENTS

| | | | |
|---|---|---|---|
| 2015/0252624 | A1 | 9/2015 | Hall et al. |
| 2015/0259988 | A1 | 9/2015 | Chen et al. |
| 2015/0354285 | A1 | 12/2015 | Hall et al. |

OTHER PUBLICATIONS

International Search Report for International Application No. PCT/IB2017/001692 dated Oct. 29, 2018, 3 pages.

* cited by examiner

CUTTING ELEMENTS, EARTH-BORING TOOLS INCLUDING THE CUTTING ELEMENTS, AND METHODS OF FORMING THE CUTTING ELEMENTS

TECHNICAL FIELD

Embodiments of the disclosure relate to cutting elements, to earth-boring tools including the cutting elements, to methods of forming the cutting elements.

BACKGROUND

Earth-boring tools for forming wellbores in subterranean formations may include cutting elements secured to a body. For example, a fixed-cutter earth-boring rotary drill bit ("drag bit") may include cutting elements fixedly attached to a bit body thereof. As another example, a roller cone earth-boring rotary drill bit may include cutting elements secured to cones mounted on bearing pins extending from legs of a bit body. Other examples of earth-boring tools utilizing cutting elements include, but are not limited to, core bits, bi-center bits, eccentric bits, hybrid bits (e.g., rolling components in combination with fixed cutting elements), reamers, and casing milling tools.

A cutting element used in an earth-boring tool often includes a supporting substrate and a cutting table. The cutting table may comprise a volume of superabrasive material, such as a volume of polycrystalline diamond ("PCD") material, on or over the supporting substrate. One or more surfaces of the cutting table act as a cutting face of the cutting element. During a drilling operation, one or more portions of the cutting face are pressed into a subterranean formation. As the earth-boring tool moves (e.g., rotates) relative to the subterranean formation, the cutting table drags across surfaces of the subterranean formation and the cutting face removes (e.g., shears, cuts, gouges, crushes, etc.) a portion of formation material.

It would be desirable to have cutting elements, earth-boring tools (e.g., rotary drill bits), and methods of forming and using the cutting elements and the earth-boring tools facilitating enhanced cutting efficiency and prolonged operational life during drilling operations as compared to conventional cutting elements, conventional earth-boring tools, and conventional methods of forming and using the conventional cutting elements and the conventional earth-boring tools.

BRIEF SUMMARY

Embodiments described herein include cutting elements, earth-boring tools, and methods of forming cutting elements. For example, in accordance with one embodiment described herein, a cutting element comprises a supporting substrate, and a cutting table attached to the supporting substrate and comprising a substantially planar apex, opposing flat surfaces extending upwardly and inwardly toward the substantially planar apex from locations proximate an interface between the cutting table and the supporting substrate, primary edge surfaces between the substantially planar apex and the opposing flat surfaces and exhibiting one or more of a radiused geometry and a chamfered geometry, opposing semi-conical surfaces intervening between the opposing flat surfaces and extending upwardly and inwardly toward the substantially planar apex from other locations proximate the interface between the cutting table and the supporting substrate, and secondary edge surfaces between the substantially planar apex and the opposing semi-conical surfaces and exhibiting one or more of another radiused geometry and another chamfered geometry.

In additional embodiments, an earth-boring tool comprises a structure having a pocket therein, and a cutting element secured within the pocket in the structure. The cutting element comprises a supporting substrate, and a cutting table attached to the supporting substrate and comprising a substantially planar apex, opposing flat surfaces extending upwardly and inwardly toward the substantially planar apex from locations proximate an interface between the cutting table and the supporting substrate, primary edge surfaces between the substantially planar apex and the opposing flat surfaces and exhibiting one or more of a radiused geometry and a chamfered geometry, opposing semi-conical surfaces intervening between the opposing flat surfaces and extending upwardly and inwardly toward the substantially planar apex from other locations proximate the interface between the cutting table and the supporting substrate, and secondary edge surfaces between the substantially planar apex and the opposing semi-conical surfaces and exhibiting one or more of another radiused geometry and another chamfered geometry.

In yet additional embodiments, a method of forming an earth-boring tool comprises forming a cutting table comprising a substantially planar apex, opposing flat surfaces extending away from the substantially planar apex at a first angle, primary radiused edge surfaces between the substantially planar apex and each of the opposing flat surfaces, opposing semi-conical surfaces intervening between the opposing flat surfaces and extending away from the substantially planar apex at a second angle different than the first angle, and secondary radiused edge surfaces between the substantially planar apex and each of the opposing semi-conical surfaces. The cutting table is attached to supporting substrate.

DETAILED DESCRIPTION

Figure 1A:
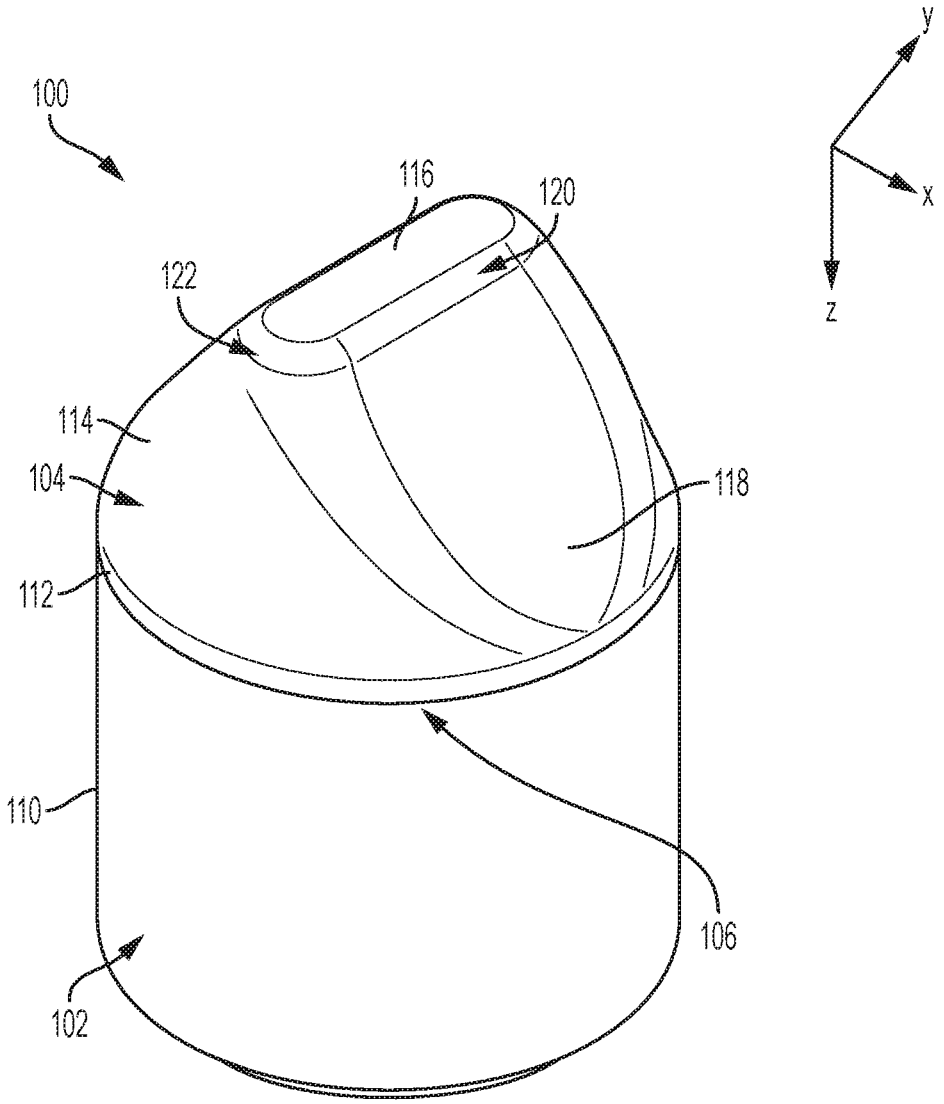
FIG. 1A is a perspective view of a cutting element, in accordance with an embodiment of the disclosure.

Cutting elements for use in earth-boring tools are described, as are earth-boring tools including the cutting elements, and methods of forming and using the cutting elements and the earth-boring tools. In some embodiments, a cutting element includes a supporting substrate, and a cutting table attached to the supporting substrate at an interface. The cutting table exhibits a chisel-shaped geometry including a substantially planar (e.g. non-arcuate, non-curved, two-dimensional) apex, opposing flat (e.g., planar) surfaces extending away from the substantially planar apex at a first angle, primary edge surfaces positioned between the substantially planar apex and the opposing flat surfaces and exhibiting one or more of radiused (e.g., curved, arcuate) geometries and chamfered (e.g., beveled) geometries, opposing semi-conical surfaces intervening between the opposing flat surfaces and extending away from the substantially planar apex at a second angle, and secondary edge surfaces positioned between the substantially planar apex and the opposing semi-conical surfaces and exhibiting one or more of radiused geometries and chamfered geometries. The cutting element may be secured within a pocket in a structure (e.g., a blade) of an earth-boring tool. The configurations of the cutting elements and earth-boring tools described herein may provide enhanced drilling efficiency and improved operational life as compared to the configurations of conventional cutting elements and conventional earth-boring tools.

The following description provides specific details, such as specific shapes, specific sizes, specific material compositions, and specific processing conditions, in order to provide a thorough description of embodiments of the present disclosure. However, a person of ordinary skill in the art would understand that the embodiments of the disclosure may be practiced without necessarily employing these specific details. Embodiments of the disclosure may be practiced in conjunction with conventional fabrication techniques employed in the industry. In addition, the description provided below does not form a complete process flow for manufacturing a cutting element or earth-boring tool. Only those process acts and structures necessary to understand the embodiments of the disclosure are described in detail below. Additional acts to form a complete cutting element or a complete earth-boring tool from the structures described herein may be performed by conventional fabrication processes.

Drawings presented herein are for illustrative purposes only, and are not meant to be actual views of any particular material, component, structure, device, or system. Variations from the shapes depicted in the drawings as a result, for example, of manufacturing techniques and/or tolerances, are to be expected. Thus, embodiments described herein are not to be construed as being limited to the particular shapes or regions as illustrated, but include deviations in shapes that result, for example, from manufacturing. For example, a region illustrated or described as box-shaped may have rough and/or nonlinear features, and a region illustrated or descried as round may include some rough and/or linear features. Moreover, sharp angles that are illustrated may be rounded, and vice versa. Thus, the regions illustrated in the figures are schematic in nature, and their shapes are not intended to illustrate the precise shape of a region and do not limit the scope of the present claims. The drawings are not necessarily to scale. Additionally, elements common between figures may retain the same numerical designation.

As used herein, the terms "comprising," "including," "containing," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature, or method act indicates that such is contemplated for use in implementation of an embodiment of the disclosure and such term is used in preference to the more restrictive term "is" so as to avoid any implication that other, compatible materials, structures, features, and methods usable in combination therewith should or must be excluded.

As used herein, the terms "longitudinal", "vertical", "lateral," and "horizontal" are in reference to a major plane of a substrate (e.g., base material, base structure, base construction, etc.) in or on which one or more structures and/or features are formed and are not necessarily defined by earth's gravitational field. A "lateral" or "horizontal" direction is a direction that is substantially parallel to the major plane of the substrate, while a "longitudinal" or "vertical" direction is a direction that is substantially perpendicular to the major plane of the substrate. The major plane of the substrate is defined by a surface of the substrate having a relatively large area compared to other surfaces of the substrate.

As used herein, spatially relative terms, such as "beneath," "below," "lower," "bottom," "above," "over," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "over" or "above" or "on" or "on top of" other elements or features would then be oriented "below" or "beneath" or "under" or "on bottom of" the other elements or features. Thus, the term "over" can encompass both an orientation of above and below, depending on the context in which the term is used, which will be evident to one of ordinary skill in the art. The materials may be otherwise oriented (e.g., rotated 90 degrees, inverted, flipped) and the spatially relative descriptors used herein interpreted accordingly.

As used herein, the singular forms "a," "an," and "the" are intended to include the plural forms as well, unless the context clearly indicates otherwise.

As used herein, the term "and/or" includes any and all combinations of one or more of the associated listed items.

As used herein, the term "configured" refers to a size, shape, material composition, orientation, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the terms "earth-boring tool" and "earth-boring drill bit" mean and include any type of bit or tool used for drilling during the formation or enlargement of a wellbore in a subterranean formation and includes, for example, fixed-cutter bits, roller cone bits, percussion bits, core bits, eccentric bits, bi-center bits, reamers, mills, drag bits, hybrid bits (e.g., rolling components in combination with fixed cutting elements), and other drilling bits and tools known in the art.

As used herein, the term "polycrystalline compact" means and includes any structure comprising a polycrystalline material formed by a process that involves application of pressure (e.g., compaction) to the precursor material or materials used to form the polycrystalline material. In turn, as used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "inter-granular bond" means and includes any direct atomic bond (e.g., covalent, metallic, etc.) between atoms in adjacent grains of hard material.

As used herein, the term "hard material" means and includes any material having a Knoop hardness value of greater than or equal to about 3,000 $Kg_f/mm^2$ (29,420 MPa). Non-limiting examples of hard materials include diamond (e.g., natural diamond, synthetic diamond, or combinations thereof), and cubic boron nitride.

Figure 1C:
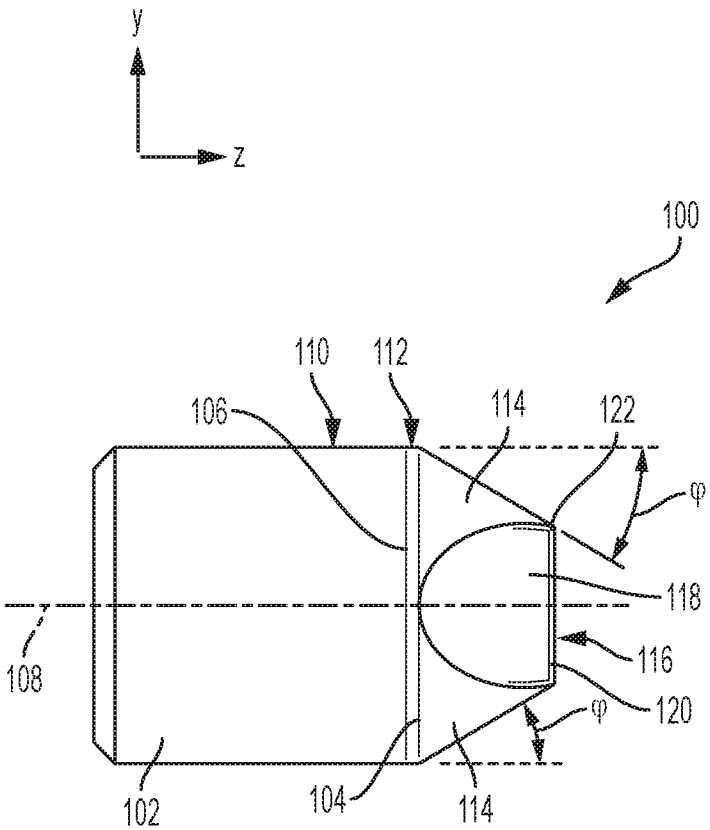
FIG. 1C is a side plan view of the cutting element of FIG. 1A.
Figure 1B:
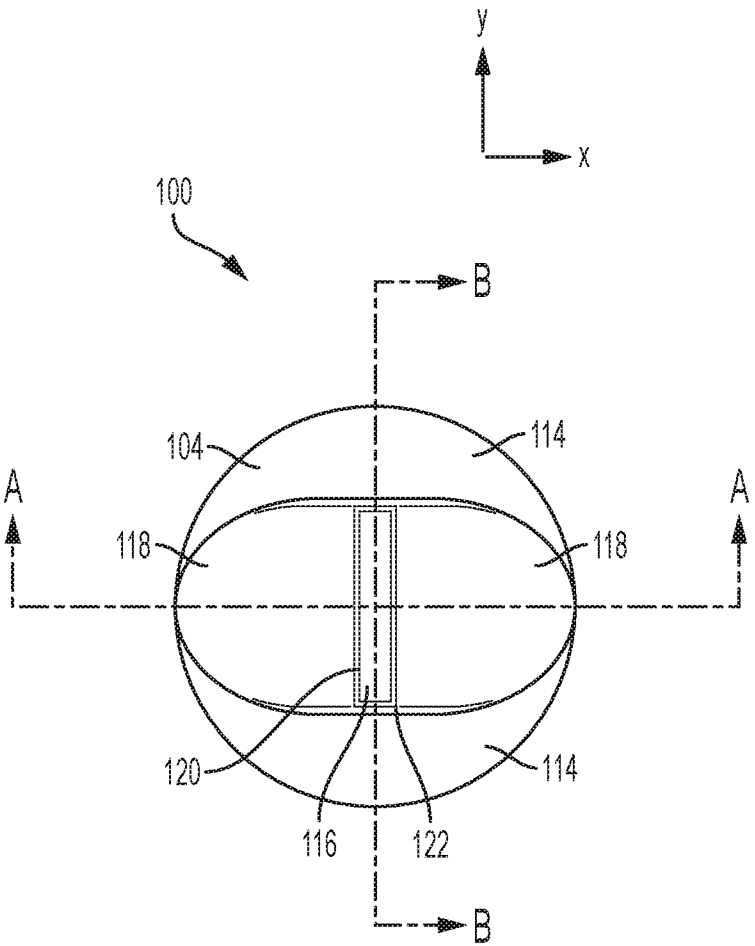
FIG. 1B is a top plan view of the cutting element of FIG. 1A.
Figure 1E:
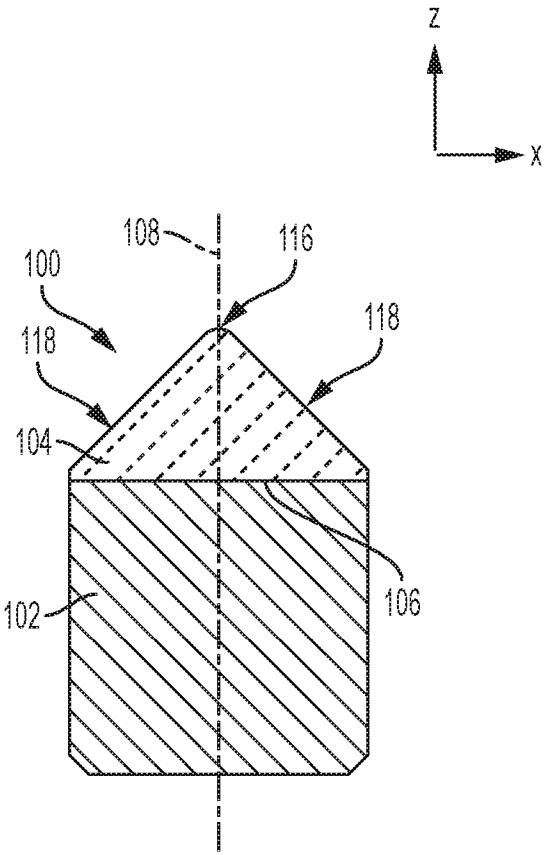
FIG. 1E is a cross-sectional view of the cutting element of FIG. 1A taken from line A-A in FIG. 1B.
Figure 1D:
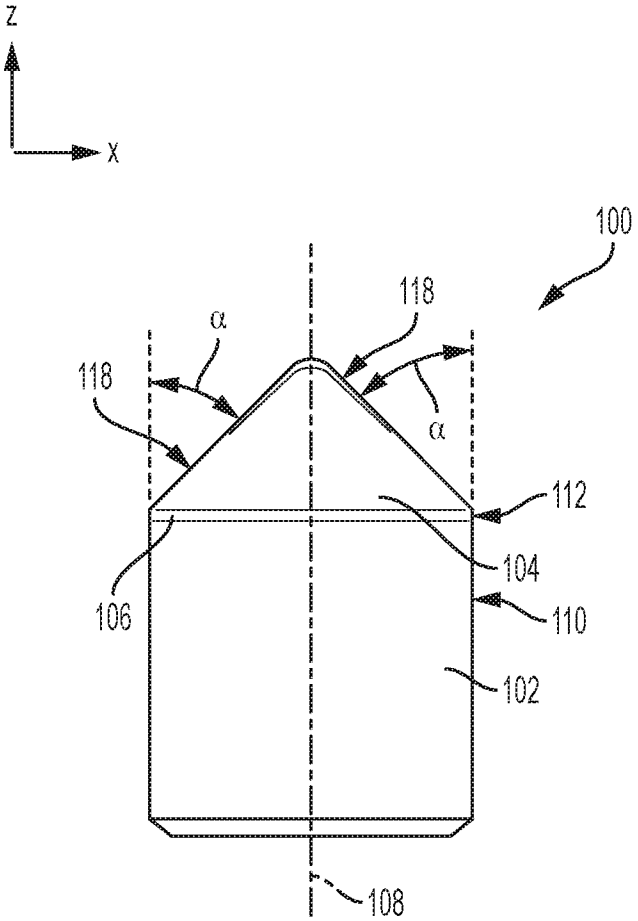
FIG. 1D is a side plan view of the cutting element of FIG. 1A taken from a direction perpendicular to the view of FIG. 1C.
Figure 1F:
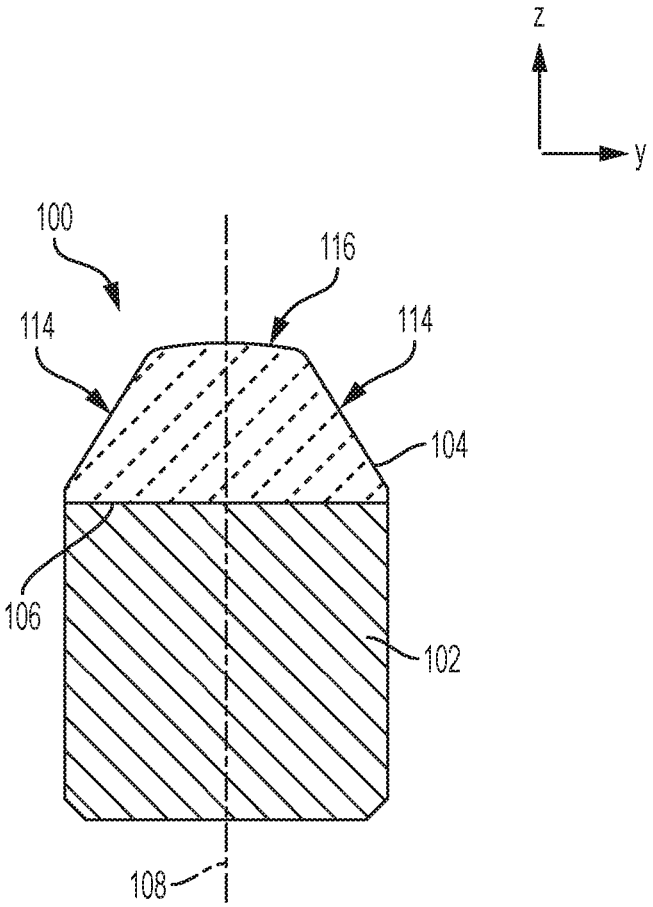
FIG. 1F is a cross-sectional view of the cutting element of FIG. 1A taken from line B-B in FIG. 1B.

FIGS. 1A through 1F are different views of a cutting element 100, in accordance with an embodiment of the disclosure. FIG. 1A is a perspective view of the cutting element 100. FIG. 1B is a top plan view of the cutting element 100. FIG. 1C is a side plan view of the cutting element 100. FIG. 1D is a side plan view of the cutting element 100 taken from a direction perpendicular to the view of FIG. 1C. FIG. 1E is a cross-sectional view of the cutting element 100 taken from line A-A in FIG. 1B. FIG. 1F is a cross-sectional view of the cutting element 100 taken from line B-B of FIG. 1B.

Referring to FIG. 1A, the cutting element 100 includes a cutting table 104 secured (e.g., attached, bonded, etc.) to a supporting substrate 102 at an interface 106. The supporting substrate 102 may comprise a material that is relatively hard and resistant to wear. By way of non-limiting example, the supporting substrate 102 may comprise a ceramic-metal composite material (also referred to as a "cermet" material). In some embodiments, the supporting substrate 102 is formed of and includes a cemented carbide material, such as a cemented tungsten carbide material, in which tungsten carbide particles are cemented together by a metallic binder material. As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide. The metallic binder material may include, for example, a metal-solvent catalyst material useful in catalyzing the formation of inter-granular bonds between diamond grains in the manufacture of polycrystalline diamond compacts. Such metal-solvent catalyst materials include, for example, cobalt, nickel, iron, and alloys and mixtures thereof. In some embodiments, the supporting substrate 102 is formed of and includes a cobalt-cemented tungsten carbide material.

The supporting substrate 102 may exhibit a generally cylindrical shape. Referring collectively to FIGS. 1C and 1D, a longitudinal axis 108 of the cutting element 100 may extend through a center of the supporting substrate 102 in an orientation at least substantially parallel to a cylindrical side surface 110 of the supporting substrate 102 (e.g., in an orientation perpendicular to a generally circular cross-section of the supporting substrate 102). The cylindrical side surface 110 of the supporting substrate 102 may be coextensive and continuous with a cylindrical side surface 112 of the cutting table 104.

Referring again to FIG. 1A, the cutting table 104 may be positioned on or over the supporting substrate 102, and may be formed of and include at least one hard material, such as at least one polycrystalline material. In some embodiments, the cutting table 104 is formed of and includes a PCD material. For example, the cutting table 104 may be formed from diamond particles (also known as "diamond grit") mutually bonded in the presence of at least one catalyst material (e.g., at least one Group VIII metal, such as one or more of cobalt, nickel, and iron; at least one alloy including a Group VIII metal, such as one or more of a cobalt-iron alloy, a cobalt-manganese alloy, a cobalt-nickel alloy, cobalt-titanium alloy, a cobalt-nickel-vanadium alloy, an iron-nickel alloy, an iron-nickel-chromium alloy, an iron-manganese alloy, an iron-silicon alloy, a nickel-chromium alloy, and a nickel-manganese alloy; combinations thereof; etc.). Other catalyst materials, for example, carbonate catalysts, may also be employed. The diamond particles may comprise one or more of natural diamond and synthetic diamond, and may include a monomodal distribution or a multimodal distribution of particle sizes. In additional embodiments, the cutting table 104 is formed of and includes a different polycrystalline material, such as one or more of polycrystalline cubic boron nitride, a carbon nitride, and other hard materials known in the art.

Referring collectively to FIGS. 1A through 1F, the cutting table 104 may exhibit a chisel shape including opposing semi-conical surfaces 114, an apex 116, and opposing flat surfaces 118. The apex 116 of the cutting table 104 may comprise an end of the cutting table 104 opposing another end of the cutting table 104 secured to the supporting substrate 102 at the interface 106. The opposing semi-conical surfaces 114 may each extend upwardly (e.g., in the positive Z-direction) and inwardly (e.g., in the positive Y-direction or the negative Y-direction) from the cylindrical side surface 112 of the cutting table 104 toward the apex 116 of the cutting table 104. The opposing flat surfaces 118 may intervene between the opposing semi-conical surfaces 114, and may extend upwardly (e.g., in the positive Z-direction) and inwardly (e.g., in the positive X-direction or the negative X-direction) from the cylindrical side surface 112 of the cutting table 104 toward the apex 116 of the cutting table 104. In addition, the cutting table 104 also includes primary edge surfaces 120 positioned between the apex 116 and the opposing flat surfaces 118, and secondary edge surfaces 122 positioned between the apex 116 and the opposing semi-conical surfaces 114.

The apex 116 of the cutting table 104 may be centered about and may extend symmetrically outward (e.g., in the positive X-direction and the negative X-direction; in the positive Y-direction and the negative Y-direction) diametrically from and perpendicular to the longitudinal axis 108 (FIGS. 1C through 1F). The apex 116 may intervene between the opposing semi-conical surfaces 114 along a vertex of the cutting table 104, and may also intervene between the opposing flat surfaces 118 along the vertex of the cutting table 104. The apex 116 may exhibit a laterally elongate geometry (e.g., a rectangular shape, a non-rectangular quadrilateral shape, an elliptical shape, etc.) defined by a laterally elongate surface (e.g., a rectangular surface, non-rectangular quadrilateral surface, an elliptical surface, etc.) of the cutting table 104. Furthermore, the apex 116 may be substantially flat (e.g., two-dimensional, planar, non-arcuate, non-curved). By way of non-limiting example, the apex 116 may exhibit a two-dimensional shape extending in the X- and Y-directions, but not extending substantially in the Z-direction. The substantially flat configuration of the apex 116 may permit a greater area of the apex 116 to interact with (e.g., engage) a surface of a subterranean formation during use and operation of the cutting element 100 as compared to conventional chisel shaped cutting elements including apexes exhibiting arcuate (e.g., curved, radiused, non-planar) geometries. The apex 116 may be oriented substantially perpendicular to the longitudinal axis 108 of the cutting element 100.

With collective reference to FIGS. 1A through 1E, each of the opposing flat surfaces 118 may extend from the primary edge surfaces 120 of the cutting table 104 to one or more locations more proximate the interface 106 between the cutting table 104 and the supporting substrate 102. In addition, as shown in FIG. 1D, the opposing flat surfaces 118 may each independently be defined by at least one angle $\alpha$ between the particular flat surface 118 of the cutting table 104 and a phantom line extending from the cylindrical side surface 112 of the cutting table 104. The angle $\alpha$ may, for example, be within a range of from about fifteen degrees (15°) to about ninety degrees (90°), such as from about forty-five degrees (45°) to about sixty degrees (60°). In some embodiments, the angle $\alpha$ is about forty-five degrees (45°). The opposing flat surfaces 118 may be oriented symmetrically relative to one another about the longitudinal axis 108 of the cutting element 100, or may be oriented asymmetrically relative to one another about the longitudinal axis 108 of the cutting element 100. Each of the opposing flat surfaces 118 may be substantially planar (e.g., non-textured, non-arcuate, non-curved), or at least one of the opposing flat surfaces 118 may be at least partially textured and/or at least partially curved.

Referring collectively to FIGS. 1A through 1C, the primary edge surfaces 120 of the cutting table 104 may be at least partially (e.g., substantially) radiused (e.g., curved, arcuate). The primary edge surfaces 120 may each independently exhibit at least one radius of curvature facilitating a smooth and non-aggressive transition from the opposing flat surfaces 118 of the cutting table 104 to the apex 116 of the cutting table 104. By way of non-limiting example, the primary edge surfaces 120 may each independently exhibit a radius of curvature within a range of from about 0.015 inch to about 0.100 inch, such as from about 0.030 inch to about 0.090 inch, or from about 0.050 inch to about 0.080 inch. In some embodiments, each of the primary edge surfaces 120 exhibits a radius of curvature of about 0.075 inch. The radius of curvature of each of the primary edge surfaces 120 may be non-tangent to the apex 116, and may be constant or non-constant across one or more lateral dimensions (e.g., a length, a width) of the primary edge surface 120. The radius of curvature of the primary edge surfaces 120 may reduce stress concentrations in the cutting table 104 relative to conventional cutting table configurations exhibiting relatively sharper (e.g., more abrupt) transitions between adjacent surfaces. Accordingly, the radius of curvature of the primary edge surfaces 120 of the cutting table 104 may reduce undesirable damage to the cutting element 100 as compared to many conventional cutting elements exhibiting chisel-shaped cutting tables. Transitions between the primary edge surfaces 120 and other portions of the cutting table 104 adjacent thereto (e.g., the apex 116, one of the opposing flat surfaces 118) may be substantially smooth and continuous, or one or more regions of transitions between the primary edge surfaces 120 and one or more of the portions of the cutting table 104 adjacent thereto may be abrupt. The primary edge surfaces 120 of the cutting table 104 may exhibit substantially the same configuration as one another (e.g., the primary edge surfaces 120 may each exhibit substantially the same shape and substantially the same dimensions), or one of the primary edge surfaces 120 may exhibit a different configuration than the other of the primary edge surfaces 120 (e.g., one of the primary edge surfaces 120 may exhibit a different shape and/or a different size than the other of the primary edge surfaces 120).

Referring collectively to FIGS. 1A through 1C and 1F, each of the opposing semi-conical surfaces 114 may extend from the secondary edge surfaces 122 of the cutting table 104 to the cylindrical side surface 112 of the cutting table 104, and may also extend between the opposing flat surfaces 118. In addition, as shown in FIG. 1C, the opposing semi-conical surfaces 114 may each independently be defined by at least one angle $\phi$ between the particular semi-conical surface 114 and a phantom line extending from the cylindrical side surface 112 of the cutting table 104. The angle $\phi$ may, for example, be within a range of from about zero degrees (0°) to about thirty-five degrees (35°). In some embodiments, the angle $\phi$ is about thirty degrees (30°). The opposing semi-conical surfaces 114 may be oriented symmetrically relative to one another about the longitudinal axis 108 of the cutting element 100, or may be oriented asymmetrically relative to one another about the longitudinal axis 108 of the cutting element 100. In addition, depending on the physical extents of the opposing flat surfaces 118, the opposing semi-conical surfaces 114 may be integral and continuous with one another, or may be discrete and discontinuous with one another.

Referring again to FIGS. 1A through 1C, the secondary edge surfaces 122 of the cutting table 104 may be at least partially (e.g., substantially) radiused (e.g., curved, arcuate). The secondary edge surfaces 122 may each independently exhibit at least one radius of curvature facilitating a smooth and non-aggressive transition from the opposing semi-conical surfaces 114 of the cutting table 104 to the apex 116 of the cutting table 104. By way of non-limiting example, the secondary edge surfaces 122 may each independently exhibit a radius of curvature within a range of from about 0.015 inch to about 0.100 inch, such as from about 0.030 inch to about 0.090 inch, or from about 0.050 inch to about 0.080 inch. In some embodiments, each of the secondary edge surfaces 122 exhibits a radius of curvature of about 0.075 inch. The radius of curvature of each of the secondary edge surfaces 122 may be non-tangent to the apex 116, and may be constant or non-constant across one or more lateral dimensions (e.g., a length, a width) of the secondary edge surface 122. Similar to the primary edge surfaces 120, the radius of curvature of the secondary edge surfaces 122 may reduce stress concentrations in the cutting table 104 relative to conventional cutting table configurations exhibiting abrupt transitions between adjacent surfaces. Accordingly, the radius of curvature of the secondary edge surfaces 122 of the cutting table 104 may reduce undesirable damage to the cutting element 100 as compared to many conventional cutting elements exhibiting chisel-shaped cutting tables. Transitions between the secondary edge surfaces 122 and other portions of the cutting table 104 adjacent thereto (e.g., the apex 116, one of the opposing semi-conical surfaces 114) may be substantially smooth and continuous, or one or more regions of transitions between the secondary edge surfaces 122 and one or more of the portions of the cutting table 104 adjacent thereto may be abrupt. The secondary edge surfaces 122 may exhibit substantially the same configuration as one another (e.g., the secondary edge surfaces 122 may each exhibit substantially the same shape and dimensions), or one of the secondary edge surfaces 122 may exhibit a different configuration than the other of the secondary edge surfaces 122 (e.g., one of the secondary edge surfaces 122 may exhibit a different shape and/or a different size than the other of the secondary edge surfaces 122).

The primary edge surfaces 120 and the secondary edge surfaces 122 may exhibit substantially the same shape and radius of curvature as one another, or one or more of the primary edge surfaces 120 may exhibit a different shape and/or a different radius of curvature than one or more of the secondary edge surfaces 122. In some embodiments, each of the primary edge surfaces 120 exhibits substantially the same shape and substantially the same radius of curvature as each of the secondary edge surfaces 122. For example, each of the primary edge surfaces 120 and each of the secondary edge surfaces 122 may exhibit substantially the same radius of curvature within a range of from about 0.015 inch to about 0.100 inch (e.g., from about 0.030 inch to about 0.090 inch, or from about 0.050 inch to about 0.080 inch). In some embodiments, each of the primary edge surfaces 120 and each of the secondary edge surfaces 122 exhibit a radius of curvature of about 0.075 inch. In additional embodiments, at least one of the primary edge surfaces 120 exhibits a different shape and/or a different radius of curvature than at least one of the secondary edge surfaces 122. For example, at least one of the secondary edge surfaces 122 may be relatively sharper (e.g., less transitioned, more abrupt) than at least one of the primary edge surfaces 120, or vice versa. In some embodiments, the secondary edge surfaces 122 exhibit a smaller radius of curvature than the primary edge surfaces 120.

In additional embodiments, one or more of the primary edge surfaces 120 and/or one or more of the secondary edge surfaces 122 may be non-radiused (e.g., non-curved, non-arcuate). For example, one or more of the primary edge surfaces 120 and/or one or more of the secondary edge surfaces 122 may be at least partially (e.g., substantially) chamfered (e.g., beveled). If present, the chamfer may be substantially linear, and may provide a non-aggressive angle leading into the apex 116 of the cutting table 104. For example, the angle of the chamfer may be within a range of from about thirty degrees (30°) to about sixty degrees (60°) relative to the apex 116, such as from forty degrees (40°) to about fifty degrees (50°), or about forty-five degrees (45°). In some embodiments, the angle of the chamfer is about forty-five degrees (45°) relative to the apex 116. In additional embodiments, one or more of the primary edge surfaces 120 and/or one or more of the secondary edge surfaces 122 independently includes more than one chamfer, such as two, three, or greater than three chamfers. For example, one or more of the primary edge surfaces 120 and/or one or more of the secondary edge surfaces 122 may be double chamfered so as to include a first chamfer adjacent to the apex 116 and exhibiting a first angle (e.g., about fifteen degrees)(15°) relative to the apex 116, and a second chamfer adjacent the first chamfer and exhibiting a second angle (e.g., about thirty degrees)(30°) relative to the apex 116. In further embodiments, one or more of the primary edge surfaces 120 and/or one or more of the secondary edge surfaces 122 may be non-radiused and non-chamfered. In embodiments wherein one or more of the primary edge surfaces 120 and/or one or more of the secondary edge surfaces 122 are non-radiused, each of the primary edge surfaces 120 and each of the secondary edge surfaces 122 may exhibit substantially the same shape as one another, or one or more of the primary edge surfaces 120 and the secondary edge surfaces 122 may exhibit a different shape than one or more other of the primary edge surfaces 120 and the secondary edge surfaces 122. As a non-limiting example, the primary edge surfaces 120 may be chamfered, and the secondary edge surfaces 122 may be radiused, or vice versa. As another non-limiting example, the primary edge surfaces 120 may each independently exhibit a single (e.g., only one) chamfer and/or a first chamfer angle relative to the apex 116, and the secondary edge surfaces 122 may each independently exhibit more than one chamfer (e.g., two chamfers) and/or may exhibit a second, different chamfer angle relative to the apex 116, or vice versa. As a further non-limiting example, the primary edge surfaces 120 may be non-radiused and non-chamfered, and the secondary edge surfaces 122 may be radiused and/or chamfered, or vice versa. The shapes of the primary edge surfaces 120 and the secondary edge surfaces 122 may be selected, at least partially based on a predetermined orientation of the cutting element 100 during use and operation thereof, to facilitate desired engagement of a surface of a subterranean formation by the cutting table 104 while also reducing stress concentrations in the cutting table 104 relative to conventional chisel-shaped cutting table configurations.

In some embodiments, the cutting table 104 is formed using one or more pressing processes followed by one or more material removal processes. As a non-limiting example, particles (e.g., grains, crystals, etc.) formed of and including one or more hard materials may be provided within a container having a shape similar to that of the cutting table 104, but including an arcuate (e.g., curved, radiused, non-planar) apex in place of the apex 116. Thereafter, the particles may be subjected to a high temperature, high pressure (HTHP) process to sinter the particles and form a preliminary cutting table. One example of an HTHP process for forming the preliminary cutting table may comprise pressing the plurality of particles within the container using a heated press at a pressure of greater than about 5.0 GPa and at temperatures greater than about 1,400° C., although the exact operating parameters of HTHP processes will vary depending on the particular compositions and quantities of the various materials being used. The pressures in the heated press may be greater than about 6.5 GPa (e.g., about 7 GPa), and may even exceed 8.0 GPa in some embodiments. Furthermore, the material (e.g., particles) being sintered may be held at such temperatures and pressures for a time period between about 30 seconds and about 20 minutes. Following the HTHP process, the preliminary cutting table may be subjected to at least one material removal process (e.g., mechanical grinding process, a chemical-mechanical planarization process, another machining process, etc.) to form the cutting table 104. For example, the material removal process may remove a portion of the arcuate apex of the preliminary cutting table to form each of the apex 116, the primary edge surfaces 120, and the secondary edge surfaces 122 of the cutting table 104. In some embodiments, the material removal process may grind the arcuate apex of the preliminary cutting table down about 0.010 inch to form the apex 116, the primary edge surfaces 120, and the secondary edge surfaces 122, wherein the apex 116 is substantially planar (e.g., non-arcuate, flat, two-dimensional) and exhibits a width of about 0.074 inch, the primary edge surfaces 120 exhibit a radius of curvature of about 0.075 inch, and the secondary edge surfaces 122 exhibit a radius of curvature of about 0.075 inch. Forming the cutting table 104 using one or more pressing processes followed by one or more material removal processes may reduce processing difficulties and/or manufacturing inconsistencies that may otherwise result from only using a pressing process to form the cutting table 104. For example, the material removal process may facilitate improved control of the dimensions and shapes of various features (e.g., the apex 116, the primary edge surfaces 120, the secondary edge surfaces 122, etc.) so as to reduce unpredictable engagement of a subterranean formation during use and operation of the cutting element 100 and increase the efficacy, consistency, and durability of the cutting element 100 as compared to many conventional cutting elements.

The supporting substrate 102 may be attached to the cutting table 104 during or after the formation of the cutting table 104. In some embodiments, the supporting substrate 102 is attached to the cutting table 104 during the formation of the cutting table 104. For example, particles formed of and including one or more hard materials may be provided within a container in a first shape, the supporting substrate 102 may be provided over the particles, the particles and the supporting substrate 102 may be subjected to an HTHP process to form a preliminary structure including a preliminary cutting table attached to the supporting substrate 102, and then the preliminary cutting table may be subjected to at least one material removal process to form the cutting table 104 (and, hence, the cutting element 100). In additional embodiments, the supporting substrate 102 is attached to the cutting table 104 after the formation of the cutting table 104. For example, the cutting table 104 may be formed separate from the supporting substrate 102 through one or more processes (e.g., molding processes, HTHP processes, material removal processes, etc.), and then the cutting table 104 may be attached to the supporting substrate 102 through one or more additional processes (e.g., additional HTHP processes, brazing, etc.) to form the cutting element 100.

Referring to FIG. 1A, the interface 106 between the supporting substrate 102 and the cutting table 104 (and, hence, opposing surfaces of the supporting substrate 102 and the cutting table 104) may be substantially planar, or may be at least partially non-planar (e.g., curved, angled, jagged, sinusoidal, V-shaped, U-shaped, irregularly shaped, combinations thereof, etc.). In some embodiments, the interface 106 between the supporting substrate 102 and the cutting table 104 is substantially planar. In additional embodiments, the interface 106 between the supporting substrate 102 and the cutting table 104 is substantially non-planar. Furthermore, each region of the cylindrical side surface 110 of the supporting substrate 102 may be substantially coplanar with each region of the cylindrical side surface 112 of the cutting table 104 most proximate thereto, or at least one region of the cylindrical side surface 110 of the supporting substrate 102 may be non-planar with at least one region of the cylindrical side surface 112 of the cutting table 104 most proximate thereto. In some embodiments, each region of the cylindrical side surface 110 of the supporting substrate 102 is substantially coplanar with each region of the cylindrical side surface 112 of the cutting table 104 most proximate thereto.

Figure 2:
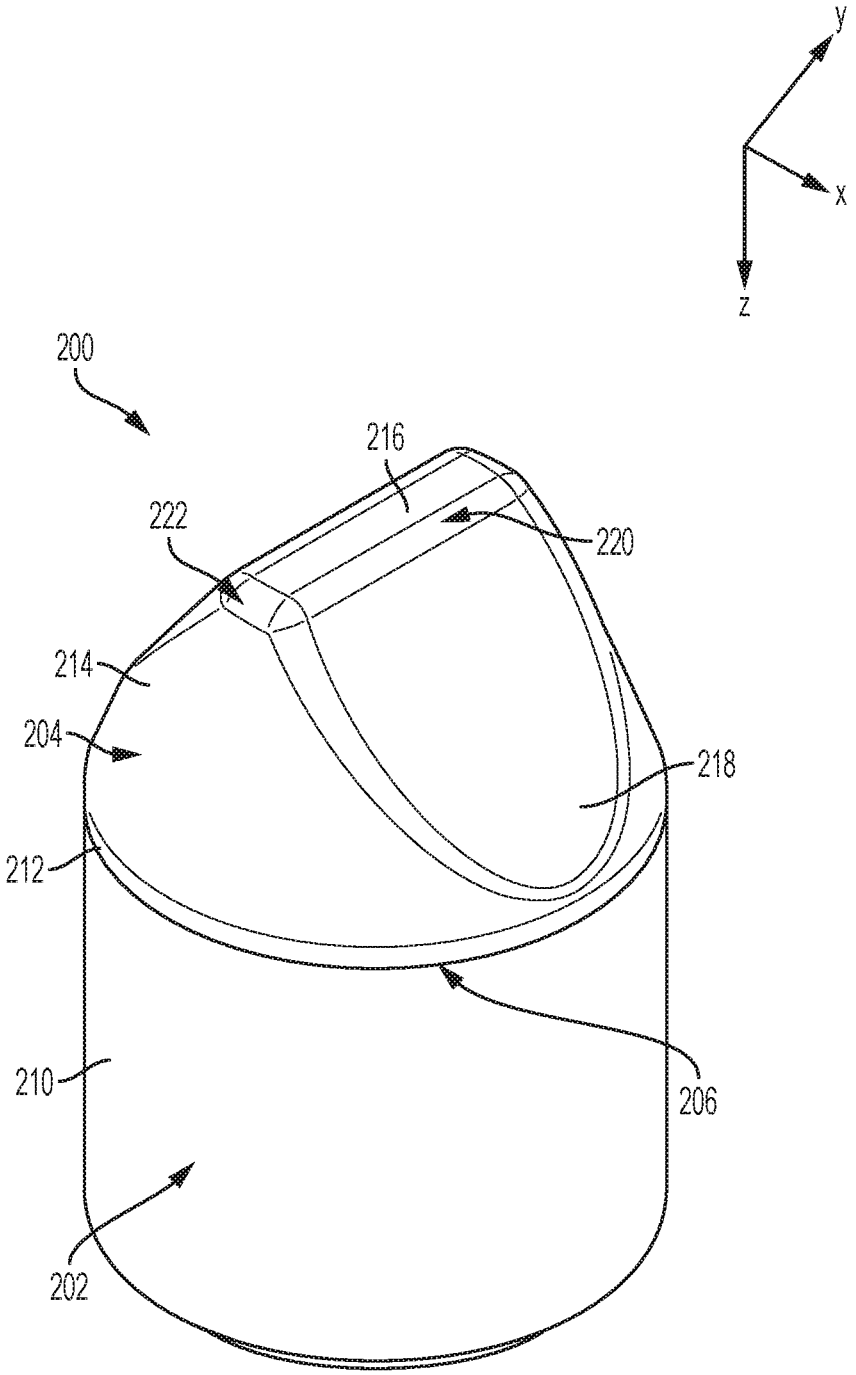
FIG. 2 is a perspective view of a cutting element, in accordance with another embodiment of the disclosure.

As previously described above, the cutting element 100 may be formed to exhibit a different configuration than that depicted in FIGS. 1A through 1F. By way of non-limiting example, FIG. 2 shows a perspective view of another cutting element configuration, in accordance with additional embodiments of the disclosure. Throughout the remaining description and the accompanying figures, functionally similar features are referred to with similar reference numerals incremented by 100. To avoid repetition, not all features shown in FIG. 2 are described in detail herein. Rather, unless described otherwise below, a feature designated by a reference numeral that is a 100 increment of the reference numeral of a previously-described feature will be understood to be substantially similar to the previously-described feature.

As shown in FIG. 2, a cutting element 200 includes a cutting table 204 secured (e.g., attached, bonded, etc.) to a supporting substrate 202 at an interface 206. The cutting element 200 may be substantially similar to the cutting element 100 shown in FIGS. 1A through 1F, except that one or more of the primary edge surfaces 220 and secondary edge surfaces 222 may respectively be relatively sharper (i.e., less transitioned, more abrupt) than the primary edge surfaces 120 and the secondary edge surfaces 122 of the cutting table 104 of the cutting element 100. For example, the primary edge surfaces 220 of the cutting table 204 may exhibit a relatively smaller radius of curvature than the primary edge surfaces 120 of the cutting table 104, and/or the secondary edge surfaces 222 of the cutting table 204 may exhibit a relatively smaller radius of curvature than the secondary edge surfaces 122 of the cutting table 104. Each of the primary edge surfaces 220 and each of the secondary edge surfaces 222 may, for example, independently exhibit a maximum radius of curvature of about 0.032 inch. In addition, the radius of curvature of at least the primary edge surfaces 220 may be tangent to apex 216. The relatively sharper profiles of the primary edge surfaces 220 and the secondary edge surfaces 222 as compared to the primary edge surfaces 120 and the secondary edge surfaces 122 of the cutting table 104 may facilitate more aggressive engagement of a subterranean formation by the cutting table 204 during use and operation of the cutting element 200 while still reducing stress concentrations in the cutting table 204 relative to conventional chisel-shaped cutting table configurations exhibiting more abrupt transitions between adjacent surfaces. In additional embodiments, one or more of the primary edge surfaces 220 and each of the secondary edge surfaces 222 may be non-radiused (e.g., chamfered, non-radiused and non-chamfered) depending on a desired use of the cutting element 200.

In some embodiments, the cutting table 204 is formed using one or more pressing processes. As a non-limiting example, particles (e.g., grains, crystals, etc.) formed of and including one or more hard materials may be provided within a container having the shape of the cutting table 204. Thereafter, the particles may be subjected to a high temperature, high pressure (HTHP) process to sinter the particles and form the cutting table 204. The HTHP process may, for example, be substantially similar to the HTHP process previously described in relation to the formation of the cutting table 104 of the cutting element 100 shown in FIGS. 1A through 1F. The cutting table 204 may be formed without the use of a material removal process following the HTHP process. Forming the cutting table 204 without the use of a material removal process following the HTHP process may facilitate increased manufacturing efficiency (e.g., may reduce the number of processing steps), while the resulting configuration of the cutting table 204 may increase the efficacy and durability of the cutting element 200 during use and operation as compared to many cutting elements not exhibiting configurations of the apex 216, the primary edge surfaces 220, and the secondary edge surfaces 222.

It will be understood by one of ordinary skill in the art that the edge surfaces described and illustrated in the present application may be of such small dimensions so as to be visually imperceptible without the aid of magnification. Accordingly, the term "edge surfaces" does not indicate a lower limit of a dimension of, for example, any radius of curvature or other arc, or of one or more chamfers of which an edge surface is comprised.

Figure 3:
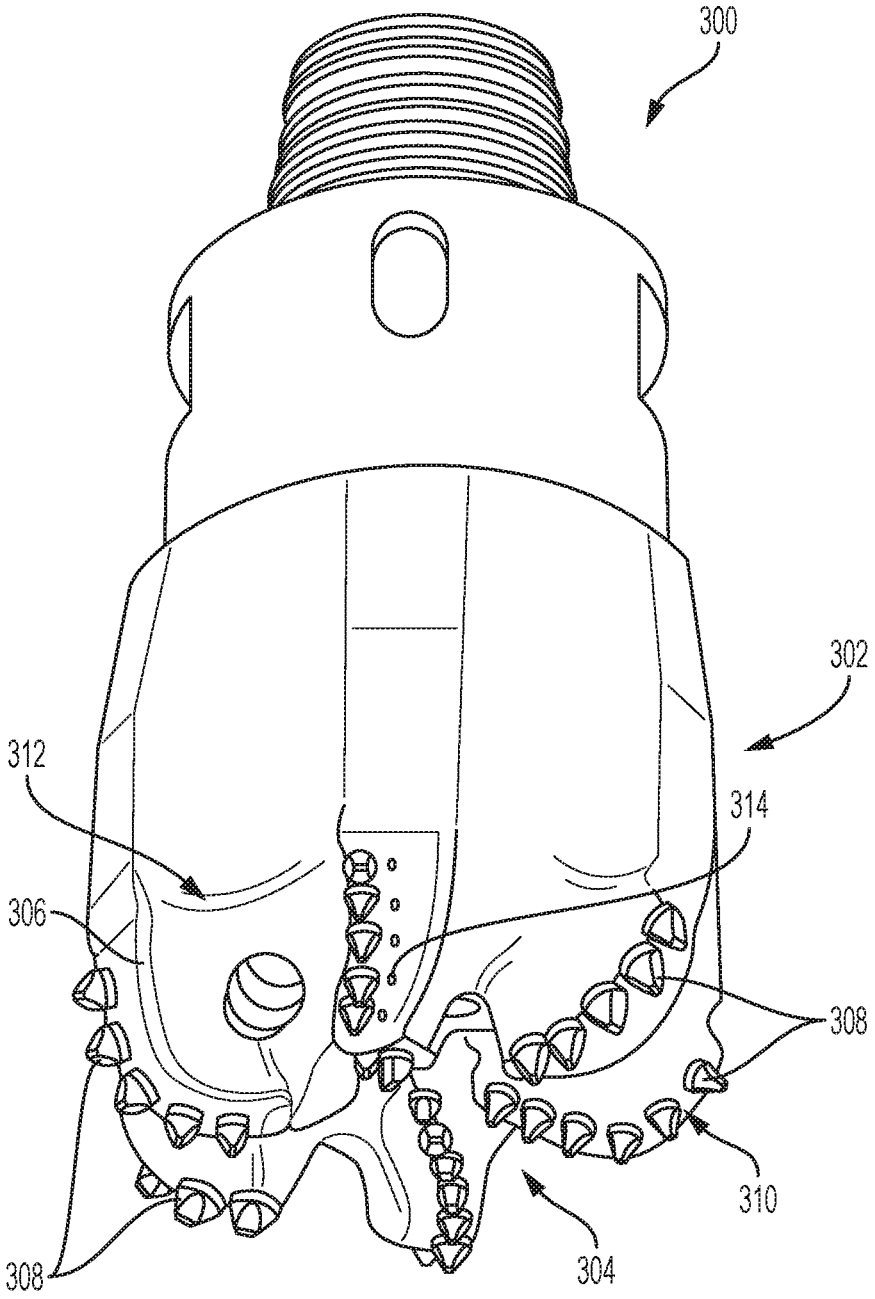
FIG. 3 is a perspective view of a rotary drill bit, in accordance with an embodiment of the disclosure.

Embodiments of the cutting elements (e.g., the cutting elements 100, 200) described herein may be secured to an earth-boring tool and used to remove material of a subterranean formation. As a non-limiting example, FIG. 3 shows a perspective view of a rotary drill bit 300 in the form of a fixed-cutter or so-called "drag" bit, according to an embodiment of the disclosure. The rotary drill bit 300 includes a body 302 exhibiting a face 304 defined by external surfaces of the body 302 that contact a subterranean formation during drilling operations. The body 302 may comprise, by way of example and not limitation, an infiltrated tungsten carbide body, a steel body, or a sintered particle matrix body, and may include a plurality of blades 306 extending longitudinally and radially over the face 304 in a spiraling configuration relative to a rotational axis of the rotary drill bit 300. The blades 306 may receive and hold cutting elements 308 within pockets 310 therein, and may define fluid courses 312 therebetween extending into junk slots between gage sections of circumferentially adjacent blades 306. One or more of the cutting elements 308 may be substantially similar to one or more the cutting element 100 (FIGS. 1A through 1F) and the cutting element 200 (FIG. 2) previously described herein. Each of the cutting elements 308 may be substantially the same as each other of the cutting elements 308, or at least one of the cutting elements 308 may be different than at least one other of the cutting elements 308. The cutting elements 308 may be secured within the pockets 310 in the blades 306 of the rotary drill bit 300 by, for example, brazing, mechanical interference, welding, and/or other attachment means known in the art. Optionally, one or more of the cutting elements 308 may be aligned with one or more alignment features 314 formed in, on, or over the body 302 of the rotary drill bit 300 to ensure proper rotation of cutting tables (e.g., the cutting tables 104, 204) of the cutting elements 308 relative to the rotary drill bit 300 and a subterranean formation during use and operation of the rotary drill bit 300. In some embodiments, the alignment features 314 may comprise one or more of holes, bumps, grooves, marks, or other features that can be discerned to align the cutting tables of the cutting elements 308. In other embodiments, one or more alignment features 314 may be formed within the pockets 310 in which the cutting elements 308 are positioned. The cutting elements 308 may be visually aligned with the alignment features 314 upon attachment to the body 302 of the rotary drill bit 300, or the cutting elements 308 may include a feature or shape complementary to the alignment features 314 for mechanical alignment therewith (e.g., if the alignment features 314 are formed in the pockets 310).

During use and operation, the rotary drill bit 300 may be rotated about the rotational axis thereof in a borehole extending into a subterranean formation. As the rotary drill bit 300 rotates, at least some of the cutting elements 308 may engage surfaces of the borehole with the cutting tables thereof and remove (e.g., cut, etc.) portions of the subterranean formation. At least one of the cutting elements 308 may be positioned on rotary drill bit 300 such that a longitudinal axis of the cutting element 308 is angled with respect to a phantom line extending normal to a surface of the subterranean formation. For example, at least one of the cutting elements 308 may be angled such that a semi-conical surface thereof (e.g., one of the opposing semi-conical surfaces 114 shown in FIGS. 1A through 1F; one of the opposing semi-conical surfaces 214 shown in FIG. 2) engages with the subterranean formation prior to an apex (e.g., the apex 116 shown in FIGS. 1A through 1F; the apex 216 shown in FIG. 2) of the cutting element 308 in the direction of movement of the cutting element 308. Put another way, the cutting element 308 may be oriented at a back rake angle with respect to the subterranean formation. In additional embodiments, one or more of the cutting elements 308 may be oriented at a forward rake angle relative to the subterranean formation, and/or one or more of the cutting elements 308 may be oriented with a neutral rake angle relative to the subterranean formation.

The cutting elements (e.g., the cutting elements 100, 200) and earth-boring tools (e.g., the rotary drill bit 300) of the disclosure may exhibit increased performance, reliability, and durability as compared to conventional cutting elements and conventional earth-boring tools. The configurations of the cutting elements of the disclosure reduce cutting table stress concentrations, increased cutting table resilience and efficiency, and provide more predictable formation engagement during use and operation of the earth-boring tools of the disclosure. In addition, methods of the disclosure permit the cutting elements of the disclosure to be quickly and easily manufactured with consistent dimensions. The cutting elements, earth-boring tools, and methods of the disclosure may provide enhanced drilling efficiency as compared to conventional cutting elements, conventional earth-boring tools, and conventional methods.

While the disclosure is susceptible to various modifications and alternative forms, specific embodiments have been shown by way of example in the drawings and have been described in detail herein. However, the disclosure is not intended to be limited to the particular forms disclosed. Rather, the disclosure encompasses all modifications, equivalents, and alternatives falling within the scope of the disclosure as defined by the following appended claims and their legal equivalents.

What is claimed is:

1. A cutting element, comprising:

a supporting substrate; and a cutting table attached to the supporting substrate and comprising:

a substantially planar apex exhibiting first opposing boundaries extending in parallel in a first lateral direction, and second opposing boundaries extending in a second lateral direction perpendicular to the first lateral direction;

opposing flat surfaces extending upwardly and inwardly toward the substantially planar apex from locations proximate an interface between the cutting table and the supporting substrate;

curved primary edge surfaces extending from the first opposing boundaries of the substantially planar apex to upper boundaries of the opposing flat surfaces;

opposing semi-conical surfaces intervening between the opposing flat surfaces and extending upwardly and inwardly toward the substantially planar apex from other locations proximate the interface between the cutting table and the supporting substrate; and curved secondary edge surfaces extending from the second opposing boundaries of the substantially planar apex to upper boundaries of the opposing semi-conical surfaces, each of the curved secondary edge surfaces having substantially the same radius of curvature as one another.

2. The cutting element of claim 1, wherein:

radii of curvature of the curved primary edge surfaces along paths extending from the first opposing boundaries of the substantially planar apex to the upper boundaries of the opposing flat surfaces are within a range of from about 0.015 inch to about 0.100 inch; and additional radii of curvature of the curved secondary edge surfaces along paths extending from the second opposing boundaries of the substantially planar apex to the upper boundaries of the opposing semi-conical surfaces are within a range of from about 0.015 inch to about 0.100 inch.

3. The cutting element of claim 2, wherein one or more of at least one of the radii of curvature of the curved primary edge surfaces and at least one of the additional radii of curvature of the curved secondary edge surfaces is about 0.075 inch.

4. The cutting element of claim 2, wherein one or more of at least one of the radii of curvature of the curved primary edge surfaces and at least one of the additional radii of curvature of the curved secondary edge surfaces is about 0.032 inch.

5. The cutting element of claim 2, wherein the radii of curvature of the primary edge surfaces are substantially the same as the additional radii of curvature of the curved secondary edge surfaces.

6. The cutting element of claim 2, wherein at least one of the radii of curvature of the curved primary edge surfaces is different than at least one of the additional radii of curvature of the curved secondary edge surfaces.

7. The cutting element of claim 6, wherein the at least one of the radii of curvature of the curved primary edge surfaces is larger than the at least one of the additional radii of curvature of the curved secondary edge surfaces.

8. The cutting element of claim 1, wherein the substantially planar apex of the cutting table is oriented perpendicular to a central longitudinal axis of the cutting element.

9. The cutting element of claim 1, wherein the second opposing boundaries of the substantially planar apex each exhibit a non-linear shape.

10. The cutting element of claim 1, wherein the second opposing boundaries of the substantially planar apex extend in parallel with one another.

11. The cutting element of claim 1, wherein the substantially planar apex exhibits a substantially rectangular peripheral shape and is oriented perpendicular to a central longitudinal axis of the cutting table.

12. An earth-boring tool, comprising:

a structure having a pocket therein; and the cutting element of claim 1 secured within the pocket in the structure.

13. The earth-boring tool of claim 12, wherein radii of curvature of the curved primary edge surfaces along paths extending from the first parallel opposing boundaries of the substantially planar apex to the upper boundaries of the opposing flat surfaces are within a range of from about 0.015 inch to about 0.100 inch; and additional radii of curvature of the curved secondary edge surfaces along paths extending from the second parallel opposing boundaries of the substantially planar apex to the upper boundaries of the opposing semi-conical surfaces are within a range of from about 0.015 inch to about 0.100 inch.

14. The earth-boring tool of claim 12, wherein the curved primary edge surfaces of the cutting table exhibit a different shape than the curved secondary edge surfaces of the cutting table.

15. The earth-boring tool of claim 12, wherein the structure comprises a blade.

16. A method of forming a cutting element, comprising:

forming a cutting table comprising:

a substantially planar apex exhibiting first opposing boundaries extending in parallel in a first lateral direction, and second opposing boundaries extending in a second lateral direction perpendicular to the first lateral direction;

opposing flat surfaces extending away from the substantially planar apex at a first angle, curved primary edge surfaces extending from the first opposing boundaries of the substantially planar apex to upper boundaries of the opposing flat surfaces, opposing semi-conical surfaces intervening between the opposing flat surfaces and extending away from the substantially planar apex at a second angle different than the first angle, and curved secondary edge surfaces extending from the second opposing boundaries of the substantially planar apex to upper boundaries of the opposing semi-conical surfaces, each of the curved secondary edge surfaces having substantially the same radius of curvature as one another; and attaching the cutting table to a supporting substrate.

17. The method of claim 16, wherein forming a cutting table comprises:

disposing a material comprising discrete particles within a container having a chisel-shaped geometry exhibiting an arcuate apex;

subjecting the material to at least one pressing process to form a preliminary cutting table exhibiting the chisel-shaped geometry of the container; and subjecting the preliminary cutting table to at least one material removal process to partially planarize the arcuate apex of the preliminary cutting table and form the cutting table.

18. The method of claim 16, wherein forming a cutting table comprises:

disposing a material comprising discrete particles within a container exhibiting a shape complementary to that of the cutting table; and subjecting the material to at least one pressing process to form the cutting table.

* * * * *